United States Patent [19]

Yokoi et al.

[11] Patent Number: 4,466,147

[45] Date of Patent: Aug. 21, 1984

[54] BED UNIT

[76] Inventors: Shinji Yokoi, 18, Arano, Kamiwada-cho; Shinji Michida, 127 Yoshiden, Taki-cho, both of Okazaki City, Japan

[21] Appl. No.: 334,917

[22] Filed: Dec. 28, 1981

[30] Foreign Application Priority Data

Dec. 27, 1980 [JP] Japan ..... 55-189132

[51] Int. Cl.[3] ..... A47C 19/06

[52] U.S. Cl. ..... 5/147; 5/164 R; 5/133

[58] Field of Search ..... 5/133, 134, 135, 145, 5/146, 147, 164 R, 164 B, 164 E

[56] References Cited

U.S. PATENT DOCUMENTS

| | | | |
|---|---|---|---|
| 370,426 | 9/1887 | Stark | 5/147 |
| 637,670 | 11/1899 | Sanor | 5/147 |
| 1,108,335 | 8/1914 | Carter | 5/133 B |
| 1,205,316 | 11/1916 | Barnum | 5/147 |
| 3,703,735 | 11/1972 | Moore | 5/147 |

FOREIGN PATENT DOCUMENTS

| | | | |
|---|---|---|---|
| 152536 | 2/1938 | Austria | 5/134 |

*Primary Examiner*—Alexander Grosz
*Assistant Examiner*—Michael F. Trettel

[57] ABSTRACT

A bed unit for saving space wherein a head end portion and a foot end portion of a frame are, respectively, movable along a wall and a floor by a driving mechanism. Thus, preparation for bed making or placing the frame back in the wall can be performed with relative ease. The bed unit includes a mattress positionable in a wall and on a floor for saving space which includes a frame on which the mattress is mounted, a first support mechanism for supporting the frame and a head side thereof, a second support mechanism for supporting the frame at a foot side thereof, a mechanism for rotatably mounting the second support to the frame and a mechanism for moving the frame such that a head end portion of the frame is moved along the wall and a foot end portion of the frame is moved along the floor.

2 Claims, 3 Drawing Figures

BED UNIT

BACKGROUND OF THE INVENTION

1. Field of the Invention

This invention relates to a bed unit for saving space.

2. Description of the Prior Art

A conventional bed unit for saving space is so constructed that a frame may be hingedly connected to a pair of side boards so as to be turned upwardly or downwardly. Therefore, a person making a bed sometimes fears that he or she will be pressed under the frame upon pivoting the same downwardly onto a floor prior to making the bed. Further, it has been found to be difficult to put the frame back in place wherein the frame is positioned so as to be out of use.

SUMMARY OF THE INVENTION

It is, therefore, an object of this invention to provide a bed unit for saving space without the aforementioned drawbacks.

According to this invention, a person making a bed may position the frame without concern for himself or herself before bedmaking, and may easily place the frame back to a position wherein the frame is out of use.

In accordance with the present invention, a bed unit is provided, having a mattress positionable in a wall and on a floor, for saving space which includes a frame on which the mattress is mounted, a first support mechanism for supporting the frame and a head side thereof, a second support mechanism for supporting the frame at a food side thereof, a mechanism for rotatably mounting the second support to the frame and a driving mechanism for moving the frame such that a head end portion of the frame is moved along the wall and a foot end portion of the frame is moved along the floor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
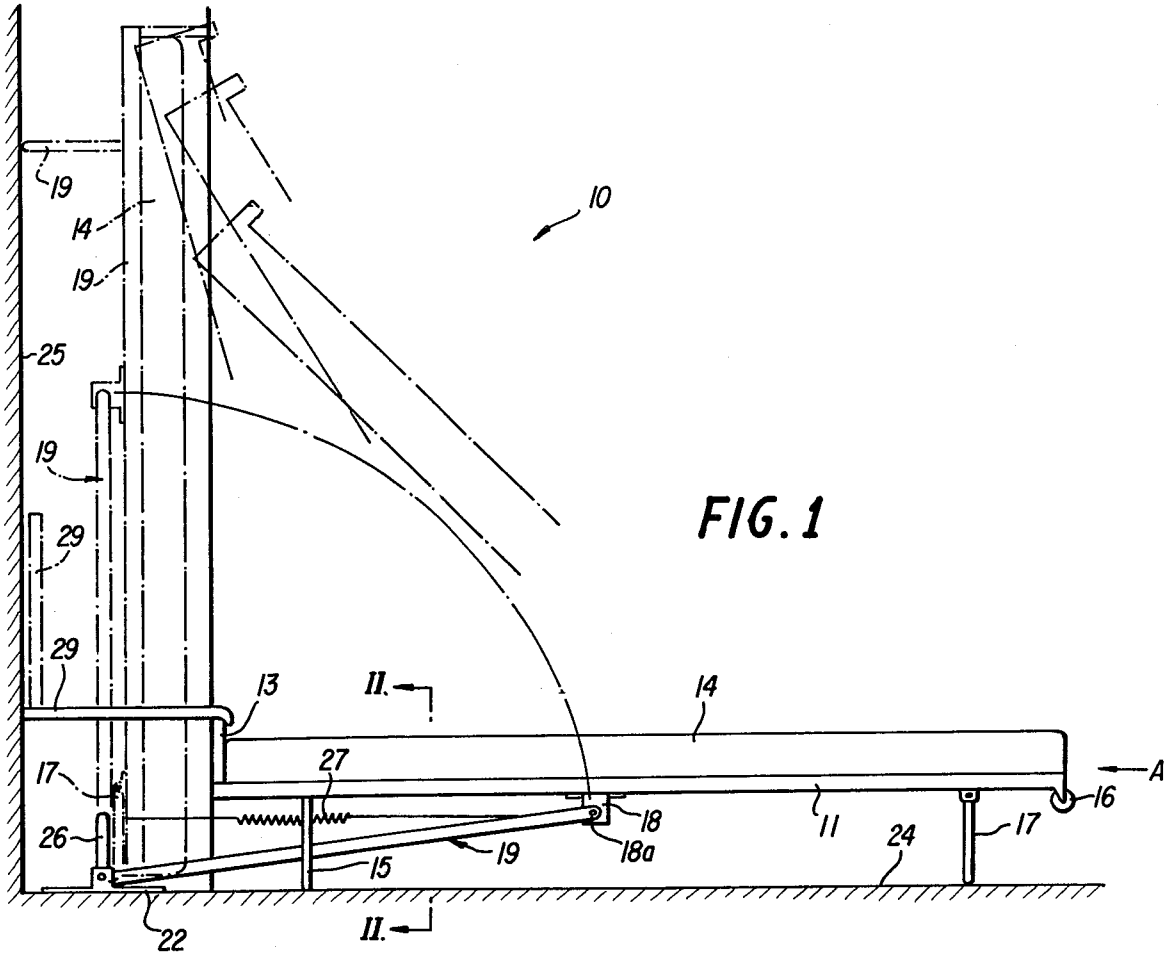
FIG. 1 is a side view of a bed unit according to the present invention.
Figure 2:
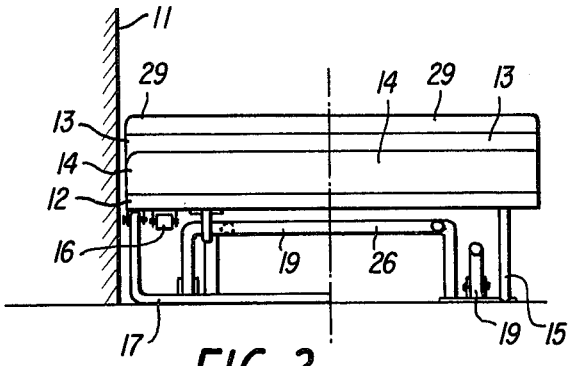
FIG. 2 is a dual view wherein a left side portion and a right side portion show, respectively, a condition seen in the direction of the arrow A, and a cross-sectional view taken along line II—II in FIG. 1.
Figure 3:
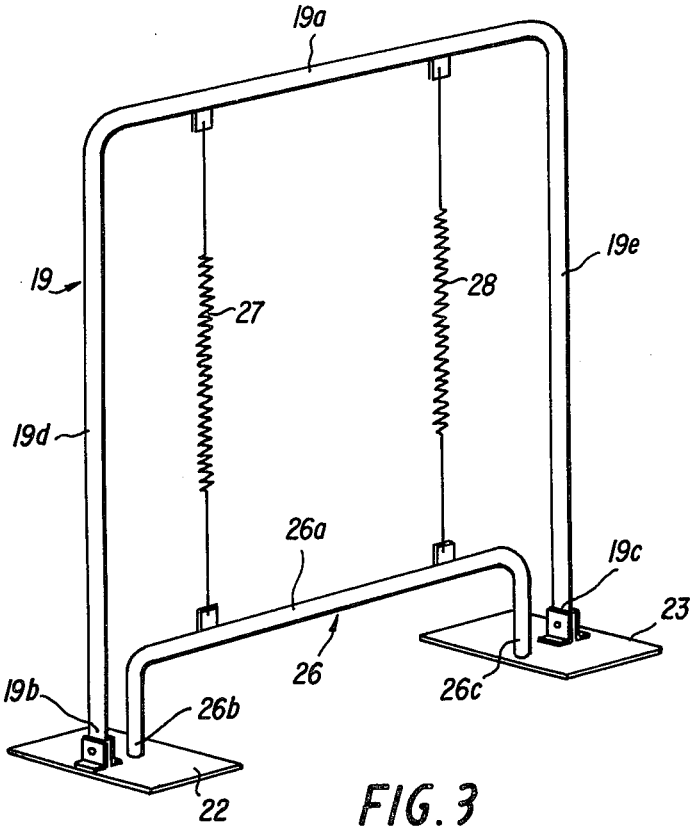
FIG. 3 shows a driving mechanism for moving the frame.

Referring now to FIGS. 1 through 3, there is shown a bed unit 10 for saving space having a frame 12 on which a mattress 14 is mounted. The mattress 14 is secured to the frame 12 by a suitable mechanism such as, for example, a belt (not shown). The frame 12 is provided at opposite ends thereof with a headboard 13 and a caster 16, respectively, and is supported by a first support 15 and a second support 17. The second support 17 is a generally U-shaped member and opposite ends thereof are pivoted to an under portion of the frame 12 so as to be rotated in a clockwise direction.

A pair of laterally spaced brackets 18 (only one being shown) are provided under the frame 12 and each of the brackets 18 has a hole **18*a* through which a central portion 19*a* of a generally U-shaped stay 19 is rotatably inserted. Opposite ends 19*b* and 19*c* of the stay 19 are hingedly connected to plates 22 and 23, respectively, both of which are fixed to a floor 24**.

A generally U-shaped pipe 26 is disposed inside of stay 19. Opposite ends of pipe 26 are fixedly connected to the plates 22 and 23 by welding so as to be perpendicular to the floor 24. Plates 22 and 23 are located near a wall 25. Between the central portion **19*a* of the stay 19 and a central portion 26*a* of the pipe 26 there are provided two springs 27 and 28 so as to rotate the stay 19 in a counter-clockwise direction in FIG. 1**.

A pair of spaced side boards 11 (only one being shown) are arranged along the wall 25 in the vertical direction. A left side portion of a shelf 29 is hingedly connected between the boards 11 and a right side of the shelf 29 is in engagement with the headboard 13 of the frame 12 so as to prevent raising of the frame due to counter-clockwise rotation of the stay 19. However, shelf 29 may be omitted by increasing the weight of the frame 12 or the mattress 14.

When the second support 17 is rotated with respect to the frame 12, the shelf 29 is then disengaged from the headboard 13 of the frame 13, frame 12 is rotated counter-clockwise about the central portion **19*a* of the stay 19 with the result that the caster 16 is brought into abutment with the floor 24. In turn, the frame 12 is transferred from the full-lined condition to phantom-lined condition in a manner that head and foot sides of the frame 12 are, respectively, along the wall 25 and the floor 24 due to counter-clockwise rotation of the stay 19**.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A bed unit having a mattress positionable in a wall and on a floor for saving space comprising:

a frame on which said mattress is mounted;

a first support means for supporting said frame at a head side thereof;

a second support means for supporting said frame at a foot side thereof;

means for rotatably mounting said second support means to said frame;

driving means for moving said frame such that a head end portion of said frame is moved along said wall and a foot end portion of said frame is moved along said floor wherein said driving means further comprises a generally U-shaped stay having a central portion rotatably connected to said frame and opposite ends hingedly connected to said floor near said wall, and pulling means for rotating said stay from said floor to said wall wherein said pulling means further comprises spring means; and a pipe member connected to said floor wherein said spring means is disposed between said central portion of said stay and said pipe connected to said floor.

2. A bed unit for saving space in accordance with claim 1, further comprising a wheel member connected to a foot end portion of said frame.

* * * * *

UNITED STATES PATENT AND TRADEMARK OFFICE

CERTIFICATE OF CORRECTION

PATENT NO. : 4,466,147

DATED : August 21, 1984

INVENTOR(S) : YOKOI ET AL.

It is certified that error appears in the above-identified patent and that said Letters Patent is hereby corrected as shown below:

On the face of the patent, please add

--Assignee: AISIN SEIKI KABUSHIKI KAISHA
Kariya City, Japan--

Signed and Sealed this

*Fourteenth* Day of *May 1985*

[SEAL]

*Attest:*

DONALD J. QUIGG

*Attesting Officer*

*Acting Commissioner of Patents and Trademarks*